US006446279B1

(12) United States Patent
Lambertson

(10) Patent No.: US 6,446,279 B1
(45) Date of Patent: Sep. 10, 2002

(54) STAINLESS STEEL DRAINAGE SURFACE HAVING SEPARATED CORRUGATED ARRAYS

(76) Inventor: Theodore C. Lambertson, 490 S. Rock Blvd., Reno, NV (US) 89502-4111

( * ) Notice: Subject to any disclaimer, the term of this patent is extended or adjusted under 35 U.S.C. 154(b) by 0 days.

(21) Appl. No.: 09/668,818

(22) Filed: Sep. 23, 2000

Related U.S. Application Data

(60) Provisional application No. 60/155,829, filed on Sep. 23, 1999.

(51) Int. Cl.[7] ..... A47B 77/06

(52) U.S. Cl. ..... 4/637; 4/640; 4/650; 4/631

(58) Field of Search ..... 4/637, 640, 650, 4/631; D23/287, 290, 284, 285

(56) References Cited

U.S. PATENT DOCUMENTS

| | | | | |
|---|---|---|---|---|
| 918,124 | A | | 4/1909 | Caldwell |
| 1,522,045 | A | * | 1/1925 | Burton |
| D87,850 | S | | 9/1932 | Mueller |
| 2,045,969 | A | | 6/1936 | Stanitz |
| D102,437 | S | | 12/1936 | Menge |
| 2,062,809 | A | | 12/1936 | Erickson |
| D102,987 | S | | 2/1937 | Janes |
| 2,121,672 | A | * | 6/1938 | Stanitz |
| D114,640 | S | | 5/1939 | Morgan |
| 2,273,606 | A | * | 2/1942 | Webber |
| 2,282,571 | A | * | 5/1942 | Grap |
| 2,663,392 | A | | 12/1953 | Miller |
| D258,834 | S | * | 4/1981 | Kinsey |
| 4,480,343 | A | * | 11/1984 | Drach |
| D298,163 | S | * | 10/1988 | Downs |
| D322,845 | S | * | 12/1991 | Gocke et al. |

* cited by examiner

*Primary Examiner*—Timothy L. Maust
*Assistant Examiner*—Khoa D. Huynh
(74) *Attorney, Agent, or Firm*—Kenehan & Lambertsen, Ltd.; John C. Lambertsen

(57) ABSTRACT

A drainage surface is provided on a conventional stamped metal sink and drain board unit. Multiple separate arrays of surface ridges are cold metal stamped in each of the drain boards. The upper ridge surfaces form a resting plane for dishware and cooking utensils while drying, permitting air circulation under the each of the kitchenware articles. Such circulating air speeds drying times and lessens the opportunities for cross-contamination problems.

3 Claims, 2 Drawing Sheets

Fig. 1
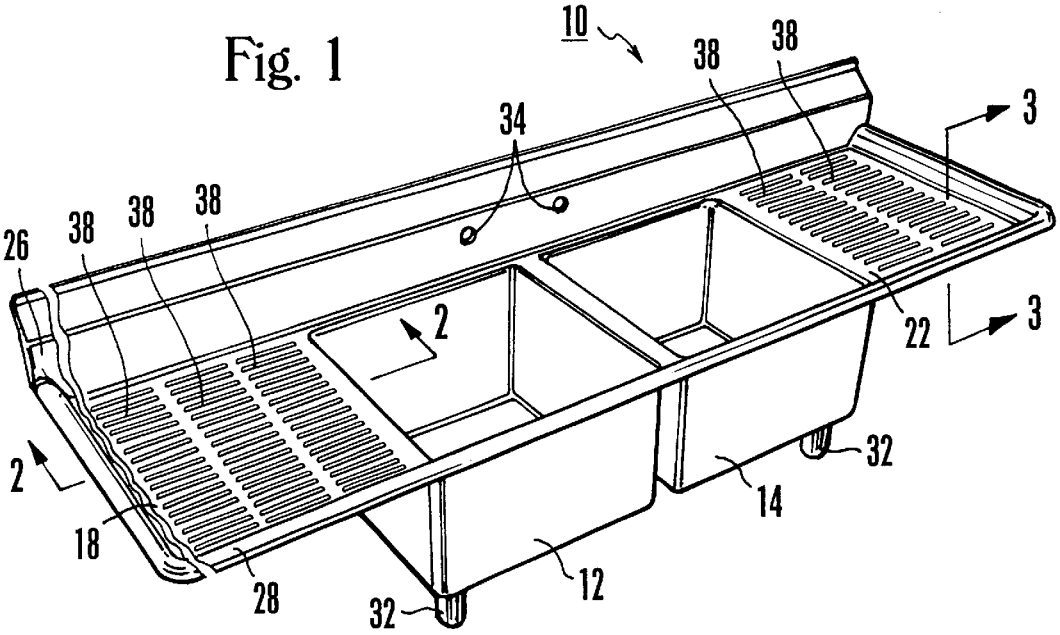
Fig. 2
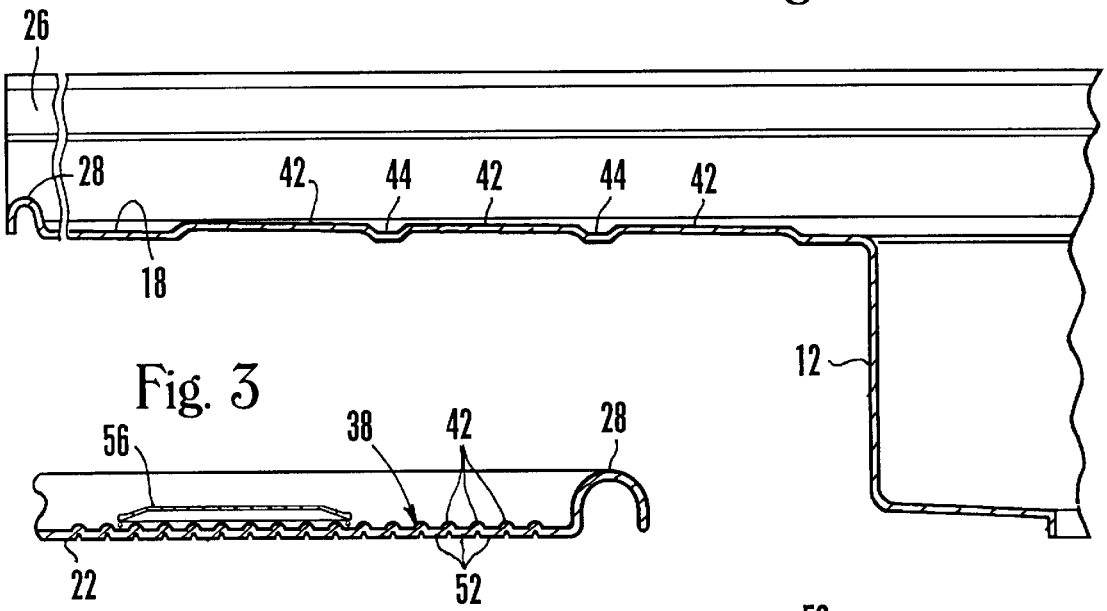
Fig. 3
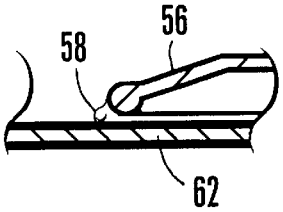
Fig. 3A
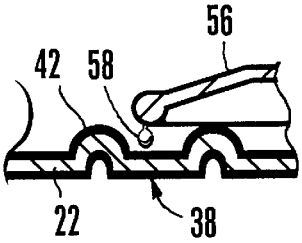
Fig. 3B

STAINLESS STEEL DRAINAGE SURFACE HAVING SEPARATED CORRUGATED ARRAYS

CROSS-REFERENCE TO RELATED APPLICATION

This application claims the benefit of U.S. Provisional Patent Application, Serial No. 60/155,829, filed Sep. 23, 1999.

BACKGROUND OF THE INVENTION

1. Field of the Invention

The present invention relates to drainage surfaces and, more particularly, to such surfaces as are provided in commercial kitchens and clean-up areas for washing dishes and cooking utensils. More specifically, the present invention relates to a stainless steel counter having a rippled surface formed therein to improve its drying characteristics, including in terms of sanitation, when such counter receives washed dishware and kitchen utensils.

2. Description of the Prior Art

As the United States begins the new millennium food-borne illnesses have become an increasing cause for concern. Food-related illnesses are believed to kill between 6000–9000 people a year, and estimates of annual food poisoning cases range from several million to tens of millions. One expert believes that even these numbers are too low, and asserts that nearly every person in the United States has some mild food-related illness at least once each year.

The re-occurrence of this problem decades after refrigeration and modern sanitary sewer systems are commonplace is testimony to a sea change in modern dietary patterns. In addition to lining up more often for the salad or sushi bar and eating more chicken and turkey than in the past, Americans also spend less time in the kitchen preparing meals. Home cooking is fast on its way to becoming a lost art, and with it, hard-won knowledge of proper cooking techniques.

Aggravating this loss of skills and knowledge is a change in the food itself—it is far better traveled than it used to be. An entree or side dish may have crossed the country, if not an ocean or two, before reaching the dinner table, picking up new bacteria along the way. Bacteria such as salmonella, which contaminates a variety of foods; *E. coli*, common in meats; vibrio, which thrives in raw shellfish; campylobacter, which is found on poultry; and listeria, found in vegetables, soft cheeses, and other foods.

Experts estimate that up to 95 percent of food-borne illnesses are preventable. However, with more than 500,000 restaurants, 175,000 institutional facilities, and 138,000 retail grocery store, a "disaster" requires but one untrained associate who does not understand the concept of cross-contamination (introducing harmful bacteria to otherwise "clean"foodstuffs). This can occur by preparing foods in an unclean sink or by allowing utensils that have come into contact with an unclean surface to touch food. Such contamination can also occur by not using separate cloths, sponges, and towels for washing dishes, wiping counters, wiping hands, and drying clean dishes.

Within the rubric "keep it cold (or hot), keep clean, keep it moving," lies the understanding that if sanitizing properly, and hands are washed, 99% of the problems can be avoided. Efforts made toward establishment of product preparation flow paths can significantly minimize the opportunities for cross-contamination.

Food experts are increasingly turning towards a new model to help decrease the risks posed by food pathogens. Known as the Hazard Analysis Critical Control Point (HACCP) model, this approach focuses on the flow of product from source to consumer. Particular attention is paid to those points where the food product is vulnerable to deterioration and/or the development of bacteria that can cause food-borne illness. Procedures are then developed and implemented to reduce these identified potential hazards.

One such area that has historically proven difficult to minimize has been the drain table on which cooking utensils and food preparation vessels are placed prior to and after cleaning. Since handling dishes while wet makes it easier to cross contaminate with bacteria from hands or other contaminated services, air-drying is preferred. Unfortunately, placement of the utensils or food preparation containers upon a flat drain service results in capillary attractive forces "drawing" water up against the item and retaining it in place. This retained water prolongs the drying process and increases the opportunities for cross-contamination. The use of drainage racks made of wood, or supplemental drainage surfaces of rubber or plastic have been tried, but each adversely effects the ability to decontaminate and keep clean the underlying draining surface. Additionally, such materials are themselves difficult to sanitize. A need thus exists for a draining surface that can easily be kept clean and uncontaminated while offering enhanced air drying characteristics for articles placed thereon.

BRIEF DESCRIPTION OF THE DRAWINGS

FIG. 1 is a perspective view showing a double sink having a drainage surface in accordance with the present invention;

FIG. 2 is a cross-sectional view taken along line 2—2 in FIG. 1, showing the elevational changes across a drainage surface in accordance with the present invention;

FIG. 3 is a cross-sectional view taken along line 3—3 in FIG. 1, showing an item of kitchenware resting upon a drainage surface in accordance with the present invention;

FIG. 3A is an enlarged, partial cross-sectional view, similar to FIG. 3, showing an item of kitchenware resting upon a conventional drainage surface;

FIG. 3B is an enlarged, partial cross-sectional view, similar to FIGS. 3 and 3A, showing an item of kitchenware resting upon a drainage surface in accordance with the present invention;

DETAILED DESCRIPTION OF THE PREFERRED EMBODIMENTS

Figure 4:
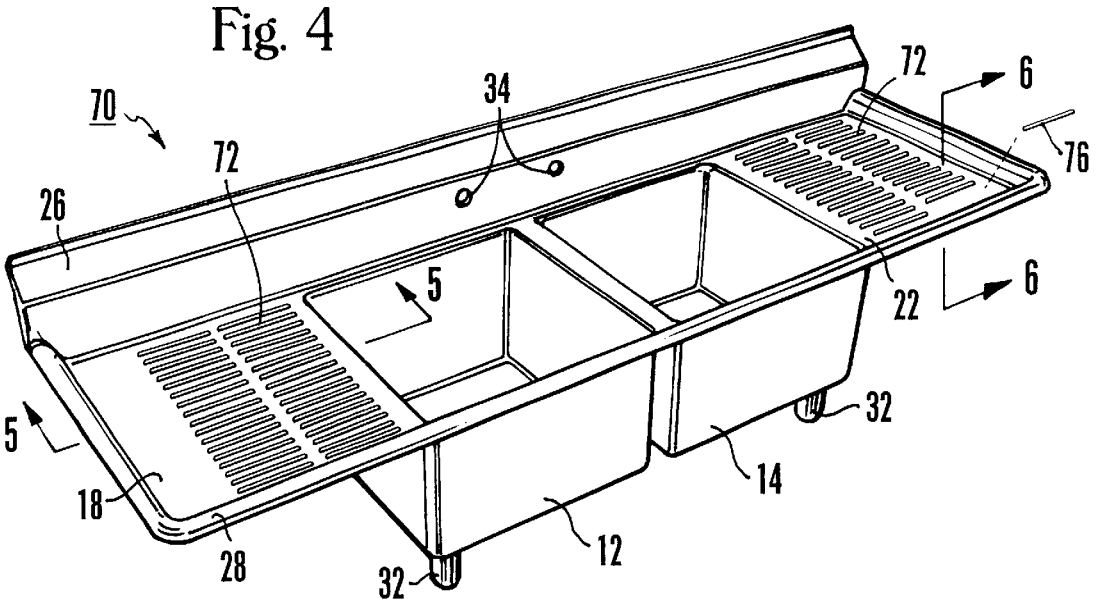
FIG. 4 is a perspective view, similar to FIG. 1, showing a double sink having an alternative drainage surface in accordance with the present invention.

Reference is now made to the drawings wherein like numerals refer to like parts throughout. A double sink 10 is shown in FIG. 1 having a first basin 12 and a second basin 14, each having an adjoining drainage area consisting of a first drainage surface 18 and a second drainage surface 22, respectively. A back splash guard 26 extends along and forms a rear elevated surface over both the first and second basins 12,14 and the first and second drainage surfaces 18, 22.

An elevated rolled edge 28 extends from one end of the splash guard 26 to the other, including about the periphery of the drainage surfaces 18, 22 and the pair of basins 12, 14, helping to prevent the spillage of water during normal use of the double sink 10. In a conventional manner, a pair of support posts 32 are attached to bottom surfaces of the basins 12, 14 to assist in mounting the double sink unit 10 within a framed counter (not shown in FIG. 1). Additionally, a pair of faucet apertures 34 are formed in the back splash guard 26, permitting the placement of the plumbing fixtures at a location appropriate for the first and second basins 12, 14. As is also shown in FIG. 1, a plurality of corrugated arrays 38 are formed on the first and second drainage surfaces 18, 22. As is best shown in FIG. 2, each of the corrugated arrays 38 consist of a plurality of pairs of surface ridges 42 that are formed in and project above the first drainage surface 18, with each separated by a lateral channel 44. The plurality of surface ridges 42 are formed in the drainage surface 18 in a manner that maintains the overall slope of the surface from the outer, elevated rolled edge 28 to the first basin 12, enhancing the tendency for water to run off the drain surface 18, notwithstanding the plurality of raised surface ridges 42.

Use of the double sink 10 is best described with reference to FIG. 3. In addition to the lateral channel 44 (not shown in FIG. 3), the plurality of surface ridges 42 forming the corrugated array 38 are separated by a corresponding plurality of longitudinal channels 52. Set in parallel to the natural slope of the drainage surfaces 18, 22, the longitudinal channels 52 further enhance the quick liquid runoff from the drainage surfaces 18, 22 and into the basins 12, 14.

A kitchenware item 56 is shown resting upon the corrugated array 38 in FIG. 3. Previously, drainage surfaces were substantially flat and they provided a mating area for the flattened areas of kitchenware. Each of such "mated" locations tended to attract and retain water, with the small separation between the drainage surface and the kitchenware functioning as a capillary. This liquid retention property is best shown with reference to FIG. 3A, where a residual liquid 58 is shown located between the kitchenware item 56 and the flat drainage surface 62. The residual liquid 58 not only extends the time required for drying the kitchenware item 56, it can also function as a reservoir containing pathogens or like contaminants—a possible source for cross contamination in the food preparation process.

The corrugated array 38 of the present invention functions to prevent the formation of such a two-piece capillary "construction," as is best shown in enlarged FIG. 3B. Instead of permitting the flattened surfaces on the kitchenware 56 to mate with a flat drainage surface 62, the plurality of surface ridges 42 physically separate the kitchenware item 56 from the drainage surface 22. With no capillary attraction resulting between the kitchenware item 56 and the drainage surface 22, the residual liquid 58 quickly drains from the kitchenware item 56 and flows down the plurality of longitudinal channels 52 and into the second basin 14.

Air is able to freely enter each of the plurality of longitudinal channels 52 as a result of the lateral channel 44 that extends perpendicularly thereto (not shown in FIGS. 3A and 3B), separating each of the corrugated arrays 38. Such ventilation assists the enhanced drainage provided by the longitudinal channels 52, and the resulting rapid drying minimizes the opportunities for contamination of the kitchenware item during the washing and draining process.

Formation of the plurality of surface ridges 42 comprising the corrugated array 38 is preferably by cold metal stamping performed after initial fabrication of the metal panel used as the drainage surface. When stainless steel of thickness 0.0625 inches is used for the drainage surface, an 80-ton press is required. Where such presses are not readily available, or in cases where a retrofit of a previously flat drainage surface is required, an alternate form of fabrication of the corrugated array is required.

In FIG. 4 a retrofit double sink 70 is shown, having similar structures to the double sink 10 of FIG. 1. The first and second basins 12, 14 are each provided a drainage surface. The first and second drainage surfaces 18, 22 are in turn each provided with a retrofit array 72 consisting of a plurality of ribs 76 that are attached to the drainage surfaces.

Figure 5:
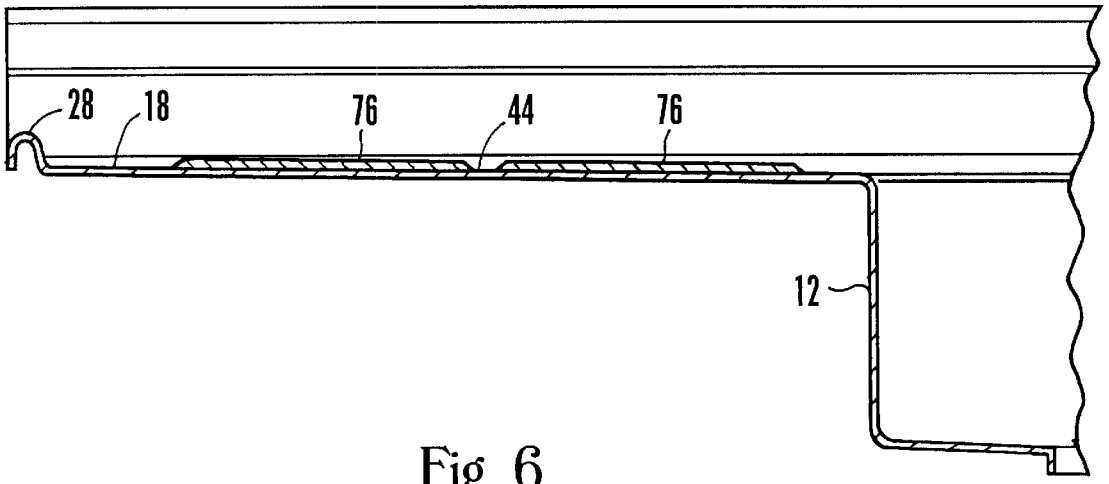
FIG. 5 is a cross-sectional view taken along line 5—5 in FIG. 4, showing the elevational changes across an alternative drainage surface in accordance with the present invention.
Figure 6:
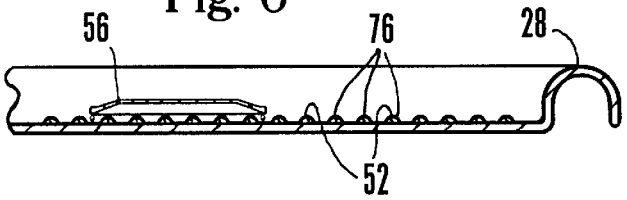
FIG. 6 is a cross-sectional view taken along line 6—6 in FIG. 4, showing an item of kitchenware resting upon an alternative drainage surface in accordance with the present invention.

Such an attachment is best shown by reference to FIG. 5, and is preferably of a conventional manner, such as by welding or by use of a suitable adhesive. The plurality of ribs 76 are positioned in such a manner as is required to create a substantially uniform arrangement having both lateral and longitudinal channels 44, 52 for the reasons previously discussed (see FIGS. 5 and 6). Once so assembled, placement of a piece of kitchenware 56 on the retrofit array 72 of the drainage surface 18 enhances drainage of any residual liquid 58 (none shown in FIG. 6) in the same manner as did the corrugated array 38 previously discussed.

In a preferred embodiment, the double sink 10 is of a conventional 16 gauge 300 type stainless steel design, such as Model #2-LIN-18-2D18CDZ of Lambertson Industries, Reno, Nevada. Each of the basins 12, 14 are of 16 gauge stainless steel welded design with ⅝" radius cove. The basin openings measure 18" by 18" and the adjoining drainage surface measures approximately 18" by 18". Each of the corrugated arrays 38 preferably consist of paired arrays of a plurality of surface ridges 42 measuring 5" in length, ⅜" in width, and 1/16" in height. Each ridge is separated from an adjacent ridge to form a series of longitudinal channels 52 of width ½", and each plurality of surface ridges 42 are separated from its paired plurality of ridges by the lateral channel 44 of width ½".

My invention has been disclosed in terms of a preferred embodiment thereof, which provides an improved drainage surface that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. An improved stainless steel drainage sink and drain board unit consisting of at least one sink and at least one drain board positioned adjacent said at least one sink, wherein the improvement comprises:

a plurality of surface ridges formed on a drainage surface of said drain board by cold metal stamping, said plurality of surface ridges configured in a manner forming at least a pair of corrugated arrays, each of the corrugated arrays separated from an adjacent corrugated array by a substantially planar lateral channel surface, said lateral channel surface in perpendicular relation to each of said plurality of surface ridges of said corrugated arrays.

2. An improved sink according to claim 1, wherein said plurality of surface ridges form three corrugated arrays, with a plurality of said lateral channel surfaces provided, each separating an adjacent one of said three corrugated arrays.

3. An improved sink according to claim 1, wherein each of said corrugated arrays are in noncontiguous relation with said at least one sink.

* * * * *